US006523468B1

(12) United States Patent
Löffler et al.

(10) Patent No.: US 6,523,468 B1
(45) Date of Patent: Feb. 25, 2003

(54) METHOD FOR MULTI-COLOR PRINTING

(75) Inventors: Gerhard Löffler, Duderstadt (DE); Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/671,822

(22) Filed: Sep. 27, 2000

Related U.S. Application Data

(63) Continuation-in-part of application No. 08/384,846, filed on Feb. 7, 1995, now abandoned.

(30) Foreign Application Priority Data

Feb. 7, 1994 (DE) ..... 44 03 673

(51) Int. Cl.[7] ..... B41M 1/14
(52) U.S. Cl. ..... 101/211; 101/248; 101/484
(58) Field of Search ..... 101/211, 181, 101/183, 216, 248, 483, 484, 485, 486, 490, DIG. 29, DIG. 36

(56) References Cited

U.S. PATENT DOCUMENTS 4,318,176 A * 3/1982 Stratton et al. ..... 101/248
4,393,398 A * 7/1983 Horiguchi et al. ..... 101/486
4,514,819 A * 4/1985 Punater et al. ..... 493/35
4,878,753 A 11/1989 Nestmeier
4,887,530 A 12/1989 Sainio
5,168,373 A * 12/1992 Nakamura ..... 358/406
5,252,838 A 10/1993 Timblin
5,294,791 A 3/1994 Pahr
5,300,961 A 4/1994 Corona et al.
5,398,603 A * 3/1995 Hartmann et al. ..... 101/183
5,570,633 A * 11/1996 Schultz et al. ..... 101/484
5,596,931 A * 1/1997 Rössler et al. ..... 101/216

FOREIGN PATENT DOCUMENTS

DE 38 00 877 A1 7/1989

OTHER PUBLICATIONS

"Test with regard to stabilization of various Halftone Screen Configuration Against Register Variations and Double Printing" (Dolezalek), Technik und Forschung, Fachdruck II, 1992, No. 86434, pp. 1–8.
"Tests of Oscillations in Cylinder Groups of Printing Machines" (Wiese et al.), Papier und Druck Publication No. 39, pp. 321–339.

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

Printing material is transported through the multicolor printing machine with a cyclically operating feeding arrangement. At least one surface of the printing material is successively imprinted with a printed image. The printed image is recorded in a image pickup and an image signal of each printed image is generated. The image signal generated from a plurality of printed images is transmitted to a control device. The control device processes the electric image signals to obtain information relating to rhythmic vibrations in the machine causing register deviations. The cause of the vibrations is determined and counter-measures are initiated for minimizing or eliminating the rhythmic vibrations.

2 Claims, 4 Drawing Sheets

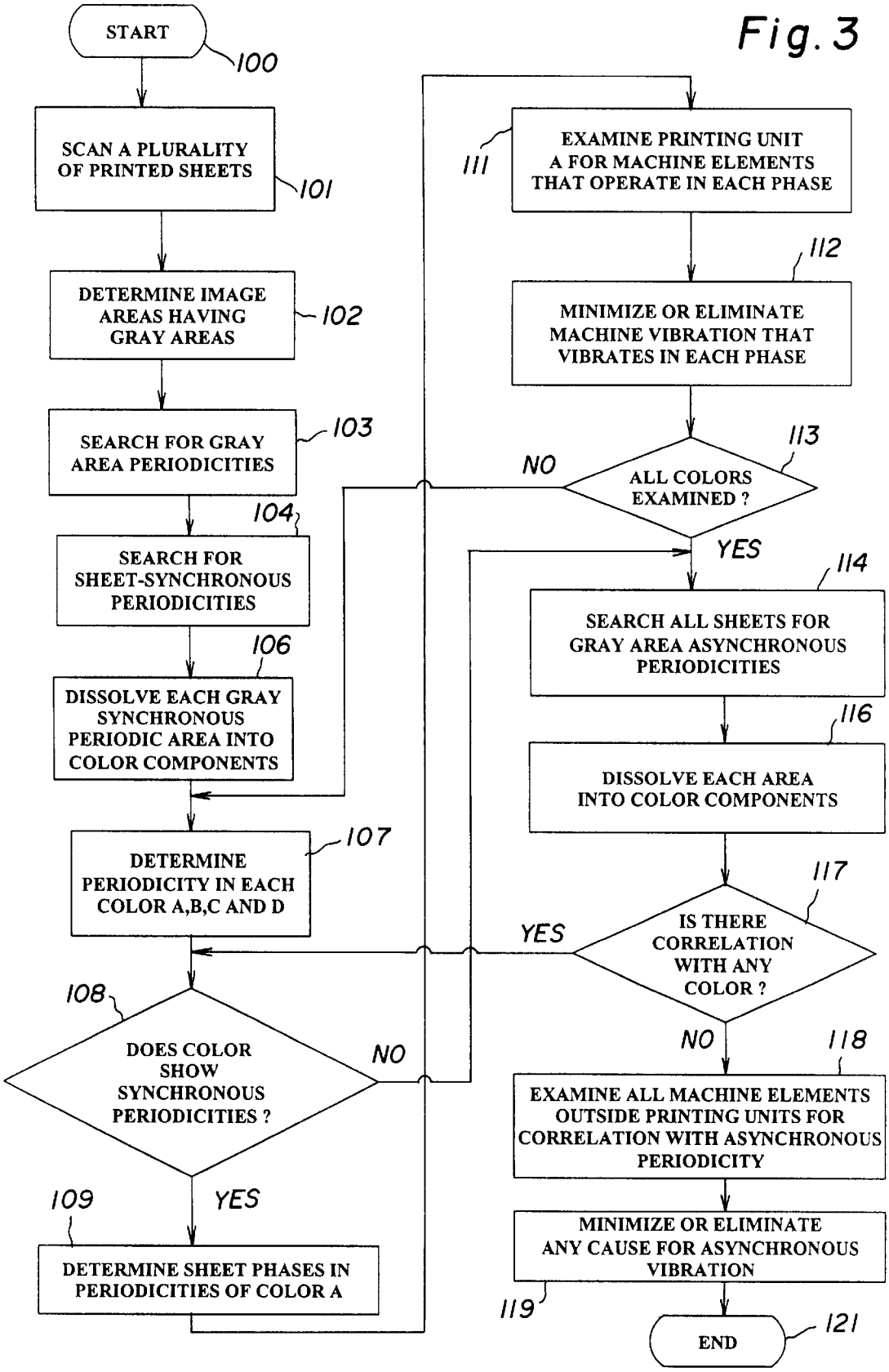
Fig. 3
START
100
SCAN A PLURALITY OF PRINTED SHEETS
101
DETERMINE IMAGE AREAS HAVING GRAY AREAS
102
SEARCH FOR GRAY AREA PERIODICITIES
103
SEARCH FOR SHEET-SYNCHRONOUS PERIODICITIES
104
DISSOLVE EACH GRAY SYNCHRONOUS PERIODIC AREA INTO COLOR COMPONENTS
106
DETERMINE PERIODICITY IN EACH COLOR A,B,C AND D
107
DOES COLOR SHOW SYNCHRONOUS PERIODICITIES ?
108
NO
YES
DETERMINE SHEET PHASES IN PERIODICITIES OF COLOR A
109
EXAMINE PRINTING UNIT A FOR MACHINE ELEMENTS THAT OPERATE IN EACH PHASE
111
MINIMIZE OR ELIMINATE MACHINE VIBRATION THAT VIBRATES IN EACH PHASE
112
ALL COLORS EXAMINED ?
113
NO
YES
SEARCH ALL SHEETS FOR GRAY AREA ASYNCHRONOUS PERIODICITIES
114
DISSOLVE EACH AREA INTO COLOR COMPONENTS
116
IS THERE CORRELATION WITH ANY COLOR ?
117
YES
NO
EXAMINE ALL MACHINE ELEMENTS OUTSIDE PRINTING UNITS FOR CORRELATION WITH ASYNCHRONOUS PERIODICITY
118
MINIMIZE OR ELIMINATE ANY CAUSE FOR ASYNCHRONOUS VIBRATION
119
END
121

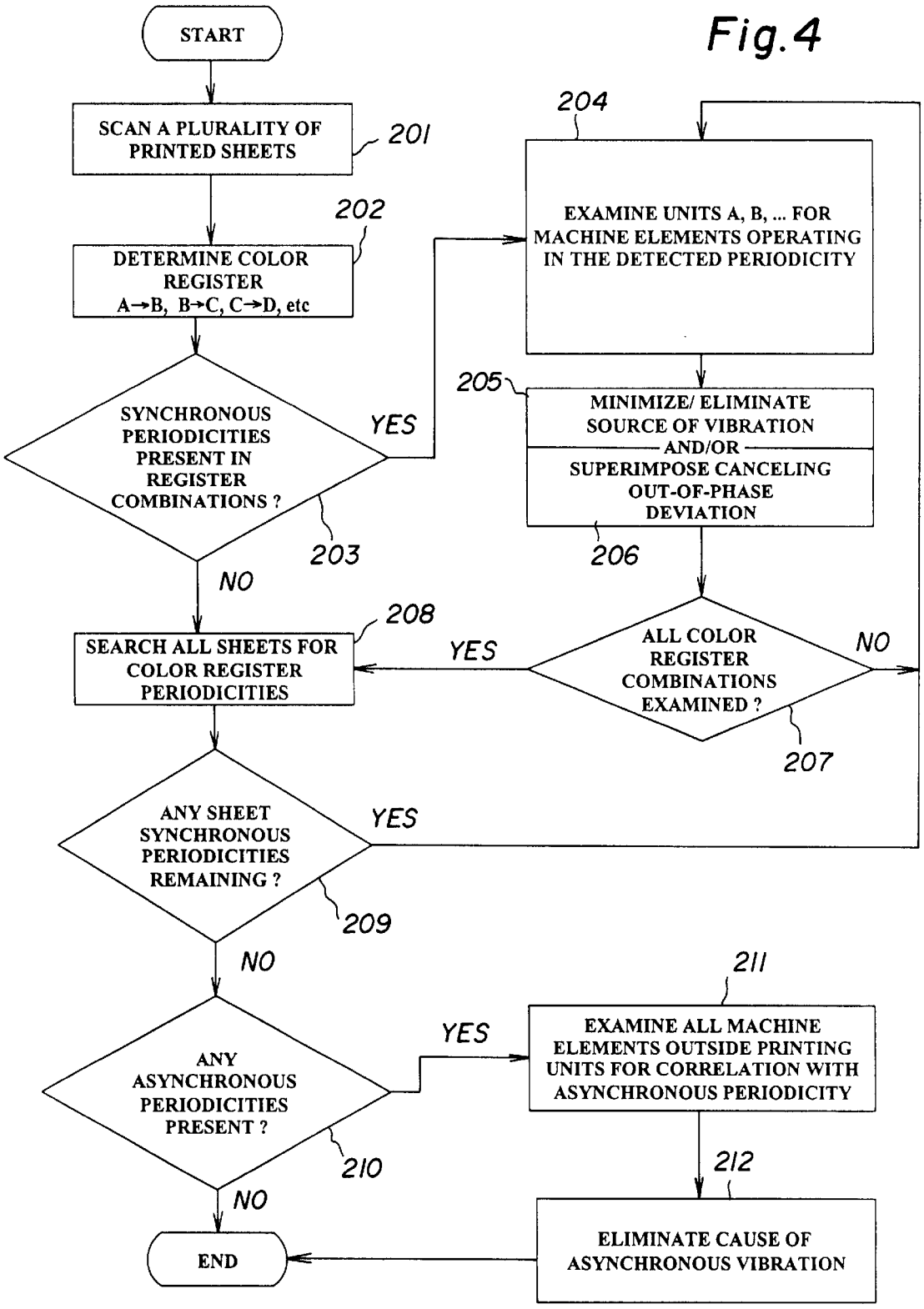
Fig.4
START
SCAN A PLURALITY OF PRINTED SHEETS
201
DETERMINE COLOR REGISTER A→B, B→C, C→D, etc
202
SYNCHRONOUS PERIODICITIES PRESENT IN REGISTER COMBINATIONS ?
YES
203
NO
EXAMINE UNITS A, B, ... FOR MACHINE ELEMENTS OPERATING IN THE DETECTED PERIODICITY
204
MINIMIZE/ ELIMINATE SOURCE OF VIBRATION
AND/OR
SUPERIMPOSE CANCELING OUT-OF-PHASE DEVIATION
205
206
ALL COLOR REGISTER COMBINATIONS EXAMINED ?
YES
NO
207
SEARCH ALL SHEETS FOR COLOR REGISTER PERIODICITIES
208
ANY SHEET SYNCHRONOUS PERIODICITIES REMAINING ?
YES
209
NO
ANY ASYNCHRONOUS PERIODICITIES PRESENT ?
YES
210
NO
EXAMINE ALL MACHINE ELEMENTS OUTSIDE PRINTING UNITS FOR CORRELATION WITH ASYNCHRONOUS PERIODICITY
211
ELIMINATE CAUSE OF ASYNCHRONOUS VIBRATION
212
END

METHOD FOR MULTI-COLOR PRINTING

CROSS-REFERENCE TO RELATED APPLICATION

This application is a continuation-in-part of application No. 08/384,846, filed Feb. 7, 1995 and now abandoned.

BACKGROUND OF THE INVENTION

FIELD OF THE INVENTION

The invention relates to a method of multi-color printing wherein the vibrations in register deviations caused in the printed image by the feeding devices are determined by means of analysis of printed sheets and a control device.

In order to insure a high quality of printing it is known to inspect the entire surface of a printed material by means of an image pickup device. The image signals obtained with the image pickup device are processed in a control device. With such conventional means it is possible to improve the printing quality to a degree that register deviations caused by interferences can be remedied by means of the adjusting elements of the machine, and whereby the remaining register deviations are reduced.

The present invention makes it possible to further improve the printing quality without adding further devices to the machine.

The solution to the problem is found, according to the invention, in that from the image signals transmitted to the control device, by means of a defined number of printed sheets, the rhythm, i.e. frequency, of the register deviations in the printed image is defined, and from which preferably the period or frequency and the magnitude of the rhythmic register deviations are determined. The rhythm of the register deviations can be used in several ways to improve the print quality as follows: In a first approach the rhythm of the register deviations is used to determine, by means of the control device, those elements of the sheet feeding devices that cause the vibrations. By identifying these elements, they can be re-designed in regard to their structural form so that the vibrations are reduced. In cases wherein the sheet feeding device, in regard to its mechanical construction, e.g. in regard to its stiffness or oscillating nature, is arranged to be adjustable, it may be possible to adjust its mechanical features so that the rhythmic register deviations are almost eliminated.

A further possibility to take advantage of the information embedded in the constant rhythmic oscillations of the printing machine is found therein that this information can be used to produce the printing form within or outside the printing machine. In this case, the positions of the image points on the printing form are changed so that the rhythmic register deviations are reduced.

The rhythm of the register deviations can be determined by means of an image pickup device, by means of which the color play in defined printed image areas, preferably gray areas, are detected, or by analysis of register marks, or image elements that may be similar to register marks. The color play appears as rhythmic color variations, the size of which can be determined by means of color location oscillations.

The register deviations can also be related to color deviations for the purpose of establishing reasonable tolerances.

SUMMARY OF THE INVENTION

It is accordingly an object of the invention to provide a method for multicolor printing, wherein a printing material is transported through a printing machine by means of a cyclically operating feeding arrangement, the method which includes:

- printing successively on at least one surface of the printing material a printed image;
- generating with an image pickup device an electric image of each printed image from at least one side of the printing material;
- transmitting the electric image of a plurality of printed images to a control device, and processing with the control device the electric images to obtain information relating to rhythmic vibrations in the machine causing register deviations.

According to the invention there is further provided a method for multicolor printing which includes determining from the information the period and magnitude of the rhythmic vibrations.

In accordance with another feature of the invention, the method includes determining from the period and magnitude of the rhythmic vibrations by means of the control device elements in the cyclically operating feeding arrangement that cause the vibrations.

In accordance with an added feature of the invention, the method includes adjusting the device elements causing rhythmic vibrations, so as to minimize the vibrations.

In accordance with an additional feature of the invention, the method includes determining with the image pickup device gray areas in the image, and the color play in the gray areas to determine register deviations.

In accordance with still another feature of the invention, the method for multicolor printing includes examining in the gray areas with the image pickup device multicolor horizontally and vertically oriented line or line-looking image elements for determining rhythmic register deviations.

The method for multicolor printing may additionally include determining periodicity in the multicolor horizontally and vertically oriented lines, and correlating the periodicity with the vibrations to determine machine elements causing the vibrations.

The method for multicolor printing according to the invention may further include the step of applying the rhythmic vibrations from the printing machine to the composition of the printing form in printing machines arranged for direct printing.

In accordance with a concomitant feature of the invention, there is provided the step of applying the rhythmic vibrations from the printing machine to a printing form produced outside the machine.

With the above and other objects in view there is also provided a multi-color printing method, which comprises the following steps:

- printing a plurality of print substrates in a printing machine having a plurality of printing units;
- scanning the print substrates;
- determining a color register between individual ones of said printing units on a plurality of the print substrates and determining whether the color register shows a sheet-synchronous periodicity; and
- if the color register shows a sheet-synchronous periodicity, determining a source of the periodicity and eliminating or minimizing a vibration causing the periodicity.

In accordance with another feature of the invention, the vibrations may be eliminated by superimposing a compensation variation of equal amplitude and out of phase by 180°.

In accordance with again a further feature of the invention, if the color register shows an asynchronous periodicity, examining all machine elements outside the printing units for correlation with the asynchronous periodicity, and eliminating or minimizing the source of the vibration.

Other features which are considered as characteristic for the invention are set forth in the appended claims.

Although the invention is illustrated and described herein as embodied in a method for multi-color printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a flowchart showing the steps of a first embodiment of the method for identifying causes of vibrations in the machine by analyzing the pattern of register vibrations in printed sheets;

FIG. 4 is a flowchart outlining the steps of a second embodiment of the method according to the invention, for identifying and eliminating causes of rhythmic vibrations.

DESCRIPTION OF THE PREFERRED EMBODIMENTS

Sheets are transported through a printing machine by means of a sheet-feeding arrangement and printed with various inks in multiple colors. If the printing machine is arranged to print directly from printing forms, the creation of information in the printed image relating to internal constant rhythmic deviations are examined by means of image analysis. The analysis is performed by examining earlier printing jobs, and entered into a control device (typically a closed-loop and open-loop system) of the printing machine.

Printed sheets printed according to a currently running print job are scanned immediately after leaving the last printing unit by means of an image pickup device. Image signals from the pickup device are entered into the control device, wherein the color play, for instance, in gray areas in selected regions are examined in order to determine the optical effect from rhythmic register deviations, which are still present after the aforesaid adjustments have been undertaken.

By means of the control device those machine elements are identified which give rise to the remaining rhythmic deviations. If the rhythmic deviations exceed a certain limit value, a signal for undertaking service and repair efforts can be performed.

One possibility for minimizing the remaining rhythmic deviations may include changing of the aforesaid machine elements, for example, driving an adjustable damping device in a compensating manner by means of the control device. We will return to this point shortly.

The stored rhythmic deviations can also be used to change the construction of a sheet printing machine and to optimize the composition of the image, for example, by application of Under-Color-Removal (UCR), by adding neutral tints (ICR), and/or by frequently modulating the reproduction data.

Figure 2:
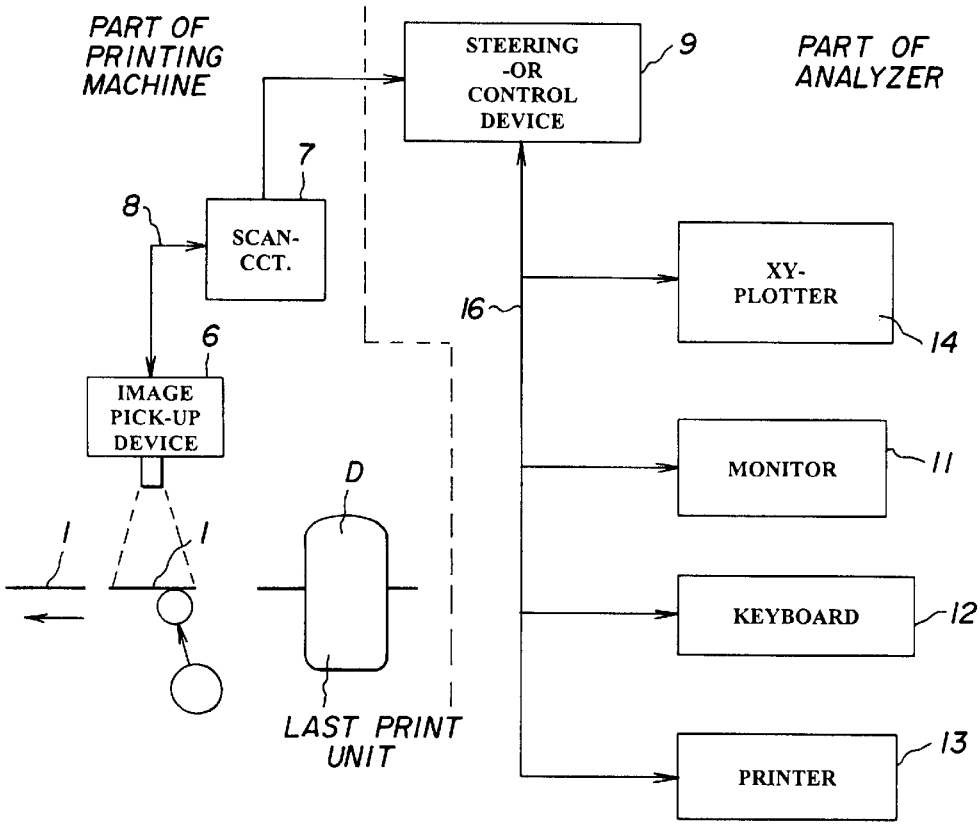
FIG. 2 is a block diagram of the vibration analyzing setup.
Figure 1:
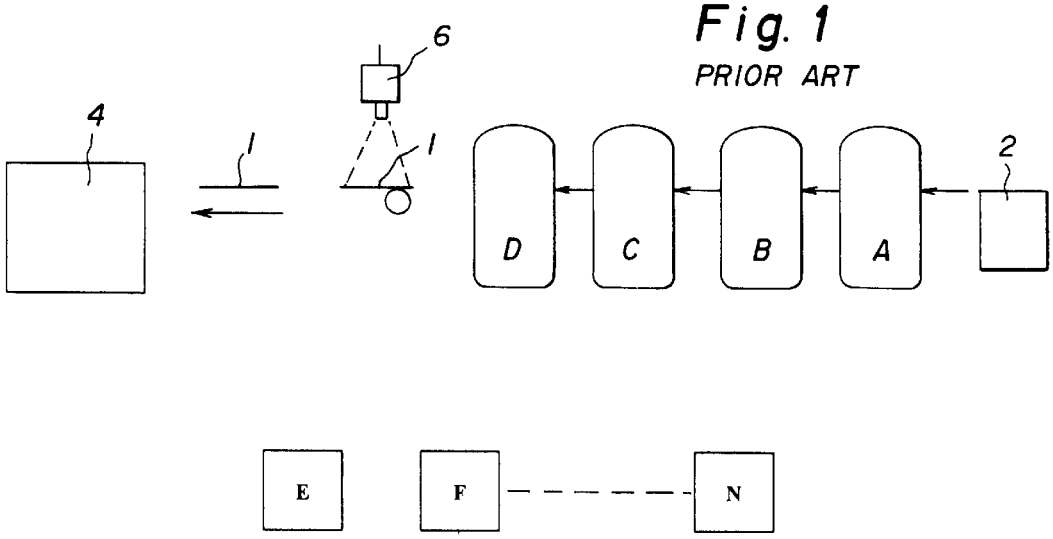
Fig. 1 PRIOR ART
FIG. 1 is a block diagram of a typical printing machine.

The general build-up of a printing machine to be analyzed for vibrations is shown in FIG. 1, and an exemplary apparatus contemplated for sheet analysis is shown in FIG. 2.

Referring now to the figures of the drawing in detail and first, particularly, to FIG. 1 thereof, there is shown a typical sheet printing machine in simplified form. The machine is composed of four printing units A, B, C and D, each applying a respective color of ink in the CMYK system to printed sheets 1, that are picked up one at the time from a sheet feeder 2, from where the sheets are transported through the printing units A–D. After exiting from the last unit D, the sheet is delivered to an inspection table whereon it is positioned under an image pickup device 6, before it continues through various conventional finishing stages, to be finally delivered to a sheet stacker 4.

In the process of transporting the sheets from stage to stage sheet grippers are placed between the various units which hand one sheet at the time from one unit to the next. The grippers and other devices operate in strongly accelerating and decelerating motions which give rise to various vibrations in the machine, which tend to adversely affect the precise registration required to insure high quality color printing, since images of the different colors ideally must be placed exactly on top of each other.

Within each printing unit all operations in processing a sheet must follow a strictly timed sequence. Any vibrations in each unit will tend to most strongly affect that particular ink color printing. The vibrations within the printing units, i.e., of the printing units relative to one another, will lead to machine-synchronous register deviations.

A number of machine units E, F . . . N perform various operations on the sheets, that are not precisely timed and any machine operations performed by these units will therefore normally not be synchronous with any of the printing of the various ink colors. These vibrations will typically lead to asynchronous register deviations.

More specifically, the difference between synchronous and asynchronous variations is the following:

Sheet-synchronous means that the periodicity in the color values is 2 sheets, 3, 4, . . . Here, the register is out—or in, for that matter—every two sheets, three sheets, four sheets, etc.

Asynchronous vibrations lead to print quality effects such as very low periodicities or increasing and decreasing oscillations of the observed characteristics. For example, if the reason for the defects is a vibration with a fixed frequency e.g. 4.5 Hz (time base) and the press speed is, say, 10,000 impressions per hour, the oscillation is 1.62 periods per press revolution or per sheet. Here, therefore, the vibration and the press are not in synchronicity.

In order to seek out and eliminate or minimize causes of vibrations that affect the ink registration, a vibration analyzing system is shown in FIG. 2, wherein a sheet 1 that has just exited from the last printing unit D is positioned under an image pickup device 6. The image pickup device 7 contains an electronic imaging tube, which may be similar to, for example, the imaging tube used in video recording devices or the like. The electron beam in the image pickup device 6 is controlled by a scanning circuit 7 via a two-way data line 8. The image signals from the scanning of the printed image on sheet 1 are temporarily stored in the control device 9, where they are analyzed for clues to causes of vibrations as described in more detail below.

The control device 9 is advantageously organized as a conventional digital computer, and may be equipped with various conventional peripheral devices, such as a monitor 11, a keyboard 12, a printer 13, and possibly other devices such as an XY plotter 14 or the like. Various data busses 16 serve to interconnect the various peripheral units and the control device 9. Control computers of similar structure are usually a part of modern printing machines for control of the printing functions of the machine.

Each printed image is analyzed for presence of gray areas on the image that may indicate a registration deviation caused by a vibration in the printing machine.

FIG. 3 shows a contemplated sequence of steps to be performed by the control device 9 under control of a program stored in a program memory.

In FIG. 3 after start step 100, a plurality of printed sheets are scanned in step 101; each sheet is scanned to determine if gray areas are present in step 102, and if gray areas are found, a search is made for gray areas that show periodicities, in other words if some gray areas are repeated with some regularity, in step 103.

By way of example, the gray areas are described in step 103 by color values which may be expressed, for example, by L*a*b* in the CIELab System. Other coordinates are LCH or Luv. These coordinates are closely related to the process ink densities of CMYK. There exist a certain number of parameters which is necessary to perform this calculation, such as the screen values CMYK in the gray area, the L*a*b* values of the process colors, the screen frequency, the image composition described by UCR, GCR etc., but these parameters are known for the respective print job. Another influence is the color register, the position of the separations one versus the other. This correlation can be calculated or found by empirical investigations. It can be stored in characteristic curves or multi-dimensional look-up tables and characteristic fields.

In step 104 a search is made for gray areas that are not only periodic, but also synchronously periodic with the sheet frequency. Sheets that have gray areas with periodicity and are synchronous with the sheet frequency can be assumed to have register deviations caused by vibrations in the printing units. In other words, the system scans the successive printed sheets, calculates the color values or the color register values and determines the periodicities from the results.

Next the gray areas are dissolved into their color components in step 106. One possibility is to calculate the individual color components, because the variations in the color register can generate doubling effects in the offset process. Doubling is caused by resplitting of ink from the blankets of the following printing units, and increases the color density values of the corresponding color separation.

The other possibility—which is more direct and faster—is to calculate the color register values themselves (position of the color separations one versus the other) from the units A to B, B to C and C to D. The other way is to measure gray areas etc. and calculate the register values indirectly, see above.

In step 107 it is determined if synchronous periodicities are related to any color components in decision step 108. Any color showing synchronous periodicity will point back to a vibration caused in the printing unit for that color.

The choice of counter-measure depends on the reasons for the rhythmic vibrations. If, for example, the reason is a lateral oscillation of the plate cylinder in a single unit with periodicity 2 sheets, the measure to eliminate the rhythms is to fix the cylinder. This will not influence the adjacent printing units. If the reason are rotative oscillations of the paper transferring cylinders e.g. in a resonance exciting frequency, the measure is to damp this oscillation using a dampener. This will influence, but the other printing units will probably have problems with this rotative oscillation and the decrease of the amplitude will be positive in any way.

For any color found that has synchronous periodicities, the phase angle in relation to the sheet frequency for that sheet is determined in step 109. The phase angle, if determined, will point to a particular area within that printing unit, 10 and an examination of the printing unit in step 111 for a machine element operating in that phase would probably lead to the source of the particular register deviation.

The best solution to be used in field 111, is probably to is eliminate the reason for the color register problem. Many of the machine elements which are responsible therefor are known. Another way is to compensate the observed variation by generating a corresponding "negative deviation," that is a superposition with a desired fault of the same amplitude but out of phase by 180°. This is the better way especially for the cases where the reason is unknown, and in most cases it is easier to generate such deviations even during the machine run.

Once a probable machine element is found, the next step 112 will indicate an effort to minimize vibrations caused by the machine elements that vibrate in the particular phase. After all colors have been examined in step 113, the next step 114 indicates a search for gray areas in all sheets that have periodicities that are not in synchronism with the sheet frequency, but still have periodic gray areas. Such gray areas would point to vibrations caused by the parts of the printing machine shown as units E, F . . . N in FIG. 1, and in particular to units that perform periodic operations that conform with the frequency of the periodic, asynchronous gray areas. In step 116 all asynchronous gray areas are dissolved into their color components. If all color components have the same asynchronous periodicity, it is confirmed in step 117 that the related vibrations are not caused by any printing unit A–D, and a search within units E, F and N would be indicated, which could lead to the cause of the vibrations in step 118, followed by an effort to eliminate any cause for the asynchronous periodic vibrations in step 119.

Referring now to FIG. 4, there is illustrated a further embodiment of the invention, namely a solution that is easier to implement than that outlined in FIG. 3:

First, in step 201, a plurality of printed sheets are scanned. In step 202, we determine the color register A to B, B to C, C to D (see, also, FIG. 5). In other words, the register deviations—if at all present—can be broken down in the specific color combinations within CMYK, for example. A query is presented in step 203 whether any of the registers show sheet-synchronous periodicities. If the return answer is positive, the program loops to 204, otherwise we continue at 208.

In step 204, the system examines the "culprit" printing unit or printing unit pair (e.g., printing units A and B) for the machine elements that operate in this periodicity. Upon confirming the source of the synchronous vibration, the vibration is minimized/eliminated in step 205 or counteracted in step 206. This is done by generating a compensation variation of the same amplitude but with a phase deviation of 180°, i.e., out of phase by 180°.

If the query at 207 receives a positive response, the program loops to step 208, otherwise it loops back to step 204 and examines further units and/or pairs of units.

All sheets are searched for color register periodicities in step 208. If any sheet-synchronous periodicities remain, the query 209 causes a loop back to step 204. Otherwise, the program continues at step 210 from where the program is looped to steps 211 and 212 if asynchronous periodicities exist. In that case, we examine all machine elements outside the printing units (i.e., outside the machine-synchronous elements) for correlation with the asynchronous periodicity and we minimize or eliminate any cause for asynchronous vibration. If no asynchronous periodicities are detected, the program is ended or looped back to step 201.

A variety of counter-measures exist in which register variations can be compensated for by superposition. The aim is to generate a corresponding "negative deviation" which leads to a superposition with a desired fault of the same amplitude but out of phase by 180°.

There exist several possibilities:

Periodic displacement of gripper bars in sheet transferring cylinders. This can be performed e.g. by piezo-electrical actuators or the like.

If it is a two-sheet periodicity in color register and we have double sized cylinders (->two plate cylinder revolutions during one transfer cylinder revolution), it is sufficient to fix one gripper bar in a displaced position and no actuators are necessary.

Lateral displacement of gear wheels of multi-sized transfer cylinders.

Influencing the gripping position, i.e., the gripper timing, during the sheet transfer from one cylinder to the adjacent cylinder.

Generating periodic torques of a certain amplitude between the corresponding printing unit. This leads to mechanical displacements and generates corresponding color register deviations.

The color register periodicities can be found using the direct way or the way of the gray area especially for the periodicities as described above.

Figure 5:
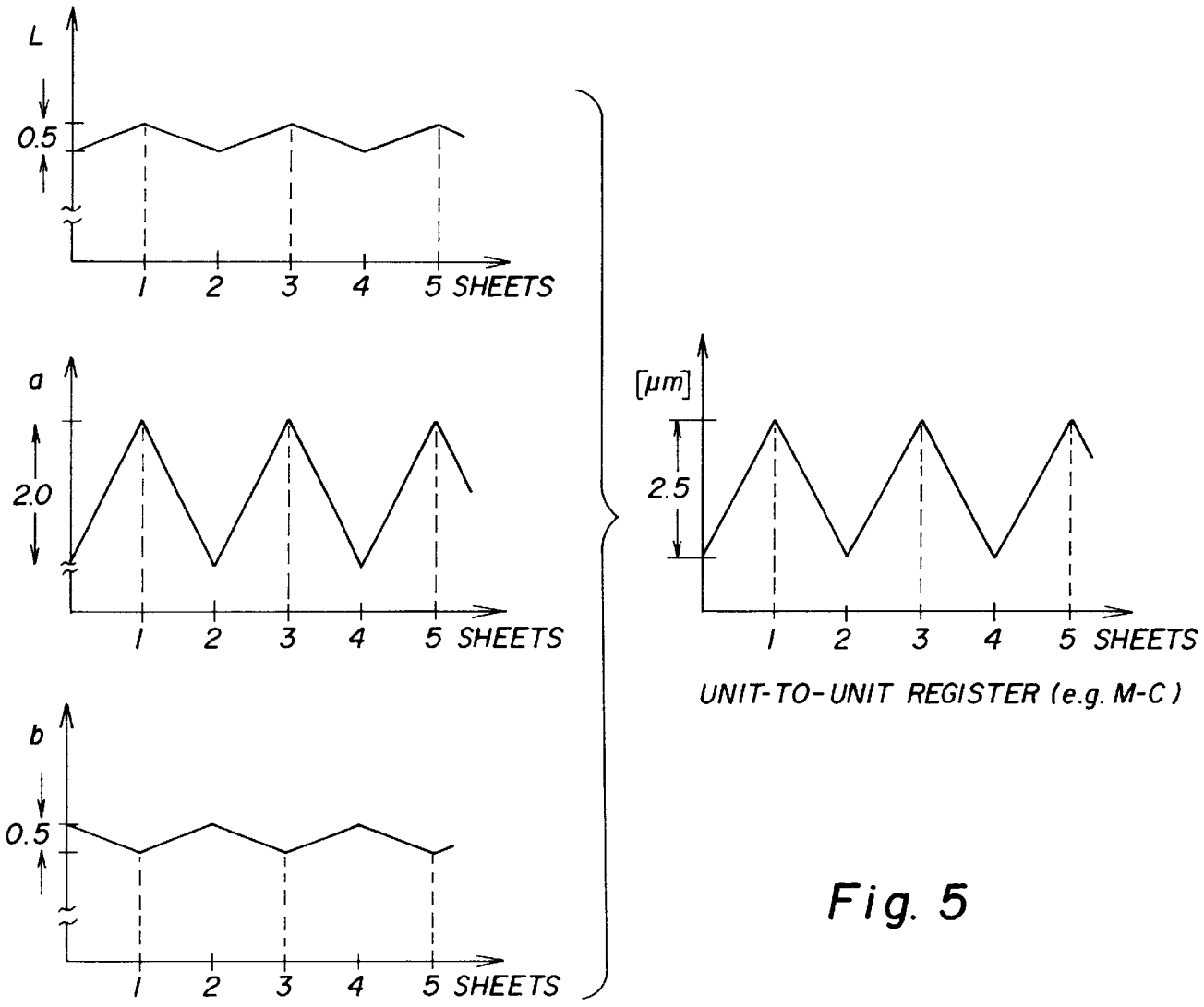
FIG. 5 is a block of graphs illustrating a numerical example of the detection of machine-synchronous vibrations.

In other words, the step 202 "determine color register" can be effected in two ways. With reference to FIG. 5, a gray patch is measured and analysed for periodicity (the exemplary graph shows a periodicity of two sheets) in the coordinates L*a*b*. Those data are then transformed in register variation between the corresponding printing units (here, unit 3 magenta to unit 2 cyan). The data needed are the amplitude [in $\mu$m] and the phase relative to the machine phase. The correlation for given conditions as screen ruling and gray patch composition can be found empirically or by calculating the sensitivity of the color coordinates versus the deviation of a color separation in the given screen. This method can be supported by the evaluation for secondary colors such as cyan+magenta, cyan+yellow, magenta+yellow, and black+cyan, black+magenta, black+yellow. Under-color removal UCR or gray color replacement are not relevant in this context because the composition of the gray area is known.

The second possibility is to measure and calculate the color register values from the units A to B, B to C, and C to D by measuring the position of the color separations relative to one another in defined register targets.

If the amplitude, or peak to peak of the register periodicity exceeds the defined threshold tolerance—for example 10 $\mu$m amplitude between adjacent printing units—then the program loops to the counter-measures 205 and/or 206 for the elimination or at least minimization of the viabrations.

In FIG. 5, the numerical examples of the color coordinates would lead to the initiation of vibration counter-measures if the threshold amplitude were set to, say, 10 $\mu$m. The measured color coordinates L (period 2 sheets, peak-to-peak 0.5), a (period 2 sheets, peak-to-peak 2.0), and b (period 2 sheets, peak-to-peak 0.5) translate to a color register periodicity between the printing unit C (magenta) and printing unit B (cyan) with a peak-to-peak deviation of 25 $\mu$m (amplitude 12.5 $\mu$m) in the same period of 2 sheets. By way of example, these translations are valid for a screen ruling of 150 dpi and a gray patch of 70% cyan, 60% magenta, and 60% yellow.

I claim:

1. A multi-color printing method, which comprises:

printing a plurality of print substrates in a printing machine having a plurality of printing units;

scanning the print substrates;

determining a color register between individual ones of said printing units on the plurality of the print substrates and determining whether the color register shows a sheet-synchronous periodicity; and if the color register shows a sheet-synchronous periodicity, determining a source of the periodicity and eliminating or minimizing a vibration causing the periodicity by superimposing a compensation variation of equal amplitude and out of phase by 180°.

2. A multi-color printing method, which comprises:

printing a plurality of print substrates in a printing machine having a plurality of printing units;

scanning the print substrates;

determining a color register between individual ones of said printing units on the plurality of the print substrates and determining whether the color register shows a sheet-synchronous periodicity;

if the color register shows the sheet-synchronous periodicity, determining a source of the sheet-synchronous periodicity and eliminating or minimizing a vibration causing the sheet-synchronous periodicity; and if the color register shows an asynchronous periodicity, examining all machine elements outside the printing units for correlation with the asynchronous periodicity, and eliminating or minimizing a source of the vibration.

* * * * *